US005771607A

United States Patent [19]

Dean

[11] Patent Number: 5,771,607

[45] Date of Patent: Jun. 30, 1998

[54] SHOE HEEL PROTECTOR

[76] Inventor: Michael B. Dean, 35 Surrey Way, Exton, Pa. 19341

[21] Appl. No.: 780,900

[22] Filed: Jan. 9, 1997

[51] Int. Cl.[6] ..... A43B 13/22

[52] U.S. Cl. ..... 36/72 B; 36/72 R

[58] Field of Search ..... 36/72 B, 72 R

[56] References Cited

U.S. PATENT DOCUMENTS

| | | | |
|---|---|---|---|
| Re. 19,543 | 4/1935 | Winget | 36/72 B |
| 1,816,784 | 7/1931 | McDermott | 36/72 B |
| 1,945,420 | 1/1934 | Charles | 36/72 B |
| 2,988,830 | 6/1961 | Zacks | 36/72 B |
| 3,063,172 | 11/1962 | Beattie . | |
| 3,104,479 | 9/1963 | D'Amico | 36/72 B |
| 3,851,412 | 12/1974 | Voegele et al. | 36/72 B |
| 4,249,321 | 2/1981 | Nagy . | |
| 5,257,469 | 11/1993 | Beasley . | |
| 5,357,694 | 10/1994 | Mauck . | |
| 5,361,517 | 11/1994 | Liener . | |

FOREIGN PATENT DOCUMENTS

| | | |
|---|---|---|
| 2338664 | 9/1977 | France . |
| 2530430 | 1/1984 | France . |
| 1142530 | 4/1960 | Germany . |
| 675193 | 9/1990 | Switzerland . |
| 2223157 | 4/1990 | United Kingdom . |

*Primary Examiner*—Ted Kavanaugh

[57] ABSTRACT

A shoe heel protector for the protection of the heel and counter of the shoe of a vehicle driver, is formed of an elongate blank of flat, planar leather, vinyl, or other suitable material. The protector includes a relatively wide center area, about which a plurality of darts are cut or otherwise formed. These darts are then sewn or otherwise secured together along their respective facing edges, to gather the periphery of the central area together to form a heel pocket therein. The heel pocket is then placed over the lower rear edge of the shoe heel, with the opposite elongate straps of the protector being secured together over the top of the shoe or foot by mating hook and loop fastening material or other suitable fastening devices. The protector is held securely in place about the shoe and foot of the driver, as the protector cannot move upwardly due to the portion of the pocket positioned beneath the heel, and cannot move forwardly due to the back wall of the pocket positioned behind the heel and counter. Rearward and downward movements of the protector are precluded by the forwardly and upwardly extending straps secured together over the top of the shoe and foot in front of the ankle. The present protector may be formed in various sizes and configurations to fit different types and sizes of shoes, as desired, with reinforcement being provided optionally for the spike heels of high heel shoes.

11 Claims, 4 Drawing Sheets

SHOE HEEL PROTECTOR

BACKGROUND OF THE INVENTION

1. Field of the Invention

The present invention relates generally to protective articles for apparel, and more specifically to a shoe heel protector which may be removably applied to a shoe to prevent scuffs and damage to the shoe while driving. The present heel protector comprises a band of durable material which is gathered in the central area thereof to form a heel pocket for a shoe. The pocket is placed about the lower and rear portion of the shoe heel, and the opposite ends are secured around the upper portion of the foot and shoe.

2. Description of the Prior Art

Proper appearance is of great importance in the business world, and a part of that appearance is provided by an attractive pair of shoes. Yet, it can be quite difficult to keep a pair of shoes looking good during the commute from home to office. This can be particularly true while driving, as the heel of the right shoe is constantly bearing against the lower side of the central chassis tunnel and adjacent floor of the vehicle while the foot is controlling the accelerator pedal. While most people make every reasonable attempt to keep the interiors of their cars clean, this area nevertheless tends to collect sand, gravel, and other debris which can be quite hard on the finish of a shoe.

This has led many individuals to wear a second pair of shoes during their commute, and to change shoes once they arrive at the office or other destination. While this solution is workable, particularly for drivers who may leave their "commuting" shoes in the car during work, it is a cumbersome means of responding to the problem, as the commuter must remember to pack his/her dress shoes when leaving home, and then take the time when arriving at the destination to change shoes, and then reverse the process for the return trip home.

Accordingly, various shoe heel protectors have been developed in response to this problem, although none respond to the problem in the manner of the shoe heel protector of the present disclosure. A review of the prior art of which the present inventor is aware, and its distinctions from the present invention, is provided below.

U.S. Pat. No. 3,063,172 issued on Nov. 13, 1962 to Sarah B. Beattie describes a Heel And Counter Protector For Shoe, comprising a molded or otherwise formed device shaped to fit the compound curvature of the back of a high heel shoe. A second flap of material folds over the back of the shoe heel to hold the device in place by the heel of the foot. The device does not extend downwardly past the counter of the shoe, i.e., that portion surrounding the back of the heel of the foot, and does not cover the downwardly extending high heel portion of the shoe, as provided by at least one embodiment of the present invention. The Beattie device requires a strap around the front of the shoe heel, while the present protector wraps over the upper portion of the shoe.

U.S. Pat. No. 4,249,321 issued on Feb. 10, 1981 to Mary J. Nagy describes a Heel Protector has a "generally hourglass shaped perimeter" (abstract, lines 2–3), with the narrowest portion of the device being precisely at the lower rear edge of the shoe heel. Thus, the lower rear sides of the heel are relatively unprotected. It appears that the reason for this relatively narrow portion at such a critical location, is to allow the protector to bend around the lower rear edge of the heel without gathering the material in any way. The present device has a widest point in this area, and gathers the material along several darts in order to form a pocket in this area which essentially completely surrounds the bottom, rear, and sides of the shoe heel.

U.S. Pat. No. 5,257,469 issued on Nov. 2, 1993 to Zachary P. Beasley describes a Shoe Protector And Method Of Using The Same, comprising a sheet of material having only a single dart at the lower center portion thereof, to gather the material slightly. This provides sufficient shaping to fit behind the convex curvature of the counter of a high heeled shoe, with an extension down the back of the heel. However, Beasley does not provide any material to fit beneath the heel, to capture the heel protector diagonally opposite the top of the foot or the instep of the shoe, as provided by the present heel protector. The additional darts and gathered portions of the present heel protector form a deeper pocket adapted to be positioned precisely at the lower rear edge of the heel, with the protector extending partially beneath the heel for better security about the shoe.

U.S. Pat. No. 5,357,694 issued on Oct. 25, 1994 to K. Joan Mauck describes a Heel Protector similar to the Beattie device discussed further above. The Mauck heel protector includes an extension which wraps over the upper edge of the counter, to hold the protector in place. The lower portion of the protector is rolled to form a tapered cylindrical shape to fit around the high heel of the shoe. The Mauck device cannot be applied to shoes having very low or no heels, while the present protector, with its heel pocket which contains the lower rear edge of the heel, is adaptable to shoes having any practicable type of heel.

U.S. Pat. No. 5,361,517 issued on Nov. 8, 1994 to Robert Liener describes a Heel Protector comprising a sheet of material with a shoe toe opening in one end thereof. The shoe is placed in the toe opening to secure one end of the device to the shoe, with the opposite end wrapping about the back of the shoe to secure to the end adjacent the toe opening. No heel pocket is disclosed to secure the device positively around the heel of the shoe to keep the device from riding up along the back of the counter, as provided by the present invention.

German Patent Publication No. 1,142,530 published on Apr. 14, 1960 to Felix Malter et al. illustrates a shoe heel protector which includes a raised semicircular portion which extends around the back of the protector, across the counter of the shoe. One embodiment appears to include a pocket for the spike heel of a shoe which completely encloses the heel, with the heel protector adapted for placement on a counterless shoe.

French Patent Publication No. 2,338,664 published on Sep. 23, 1977 to Claude E. Lamotte illustrates a shoe heel protector for high heeled shoes. The device is not adaptable to shoes having low heels or no heels, as a heel pocket is formed which encloses the heel about at least the majority thereof, with either an additional wall or a strap passing around the front of the high heel portion.

French Patent Publication No. 2,530,430 published on Jan. 27, 1984 to SEMPA illustrates a shoe heel protector similar to the device of the French '664 publication described immediately above. The device of the '430 patent is adapted for use with shoes having relatively low heels, however, with a strap extending about the front of the ankle of the wearer as well as around the front of the heel. A second embodiment for high heeled shoes is similar to the device of the German '530 patent discussed further above.

British Patent Publication No. 2,223,157 published on Apr. 4, 1990 to Elaine M. Robson describes Improvements In Or Relating To Footwear comprising a heel protector molded of plastic, according to the specification. The device extends along the entire sole of the shoe and includes multiple straps, rendering the device considerably more complex than the present heel protector.

Finally, Swiss Patent Publication No. 675,193 published on Sep. 14, 1990 to Adrienne Defago-Beyeler illustrates a shoe heel protector similar to that of the French '430 patent discussed further above, with little relationship to the present device.

None of the above inventions and patents, either singly or in combination, is seen to describe the instant invention as claimed.

SUMMARY OF THE INVENTION

By the present invention, a shoe heel protector is disclosed. The present heel protector is preferably formed of a single flat, planar elongate piece of leather, vinyl, or other suitably durable material, and is made to fit the counter and lower rear portion of the heel by cutting or otherwise forming a plurality of darts in the opposite upper and lower edges and sewing or otherwise securing the edges of the darts together to form a heel pocket. At least one of the darts may be reinforced as desired, for greater strength in high pressure areas such as beneath the tip of a high heel. The heel pocket is placed around the lower rear edge of the shoe heel, with the opposite straps of the protector wrapped forwardly over the upper portion of the foot or shoe and secured together by means of mating hook and loop fastening material. Thus, the protector cannot slip forward due to its passage about the back of the heel or counter of the shoe, and cannot slip upwardly due to the portion of the protector beneath the bottom of the heel. Downward and rearward movements are precluded by the mating straps over the top of the shoe or foot. The device may be formed in various shapes and sizes to fit various types and sizes of shoes.

Accordingly, it is a principal object of the invention to provide an improved shoe heel protector which is adapted for wear in an automobile by the driver of the vehicle, to protect the shoe from wear against the central tunnel or other areas of the vehicle.

It is another object of the invention to provide an improved shoe heel protector which is formed of a flat, planar elongate sheet of leather, vinyl, or other suitable material, having a plurality of darts formed therein with their edges secured together to form a heel pocket.

It is a further object of the invention to provide an improved shoe heel protector which heel pocket is adapted to secure about the back side of the heel or counter and beneath the heel of the shoe, to form a pocket or cup containing the lower and rearmost portion of the heel and shoe therein.

Still another object of the invention is to provide an improved shoe heel protector having opposite elongate straps extending from the central pocket portion, with the straps adapted to secure about the upper portion of the shoe or foot in front of the ankle by means of mating hook and loop fastening material or other suitable fastening means.

An additional object of the invention is to provide an improved shoe heel protector which is precluded from forward or upward motion by means of the heel pocket portion, and precluded from downward or rearward motion by means of the mating straps.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
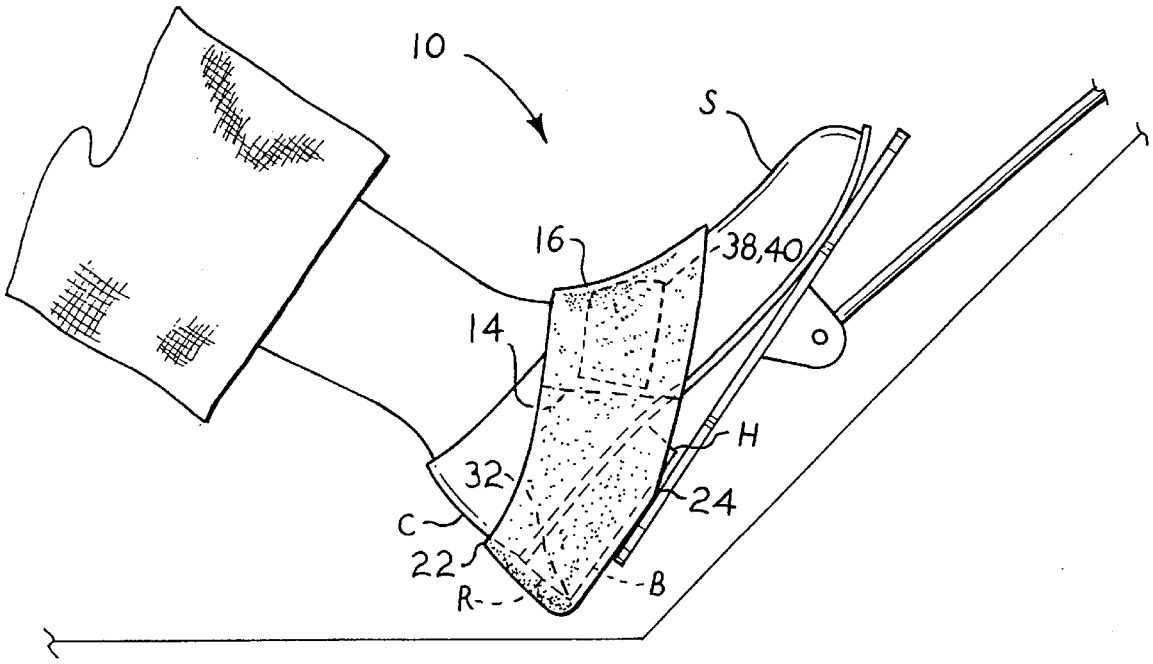
FIG. 1 is a side elevation view of the shoe heel protector in use, showing its fit about the foot and shoe and the coverage of the heel and counter portions of the shoe by the protector.

The present invention comprises various embodiments of a shoe heel protector, a first embodiment of which is shown in use in FIG. 1 and designated with the numeral 10. The present protector 10 wraps about the counter and lower rear heel portions of a shoe, to protect those portions of the shoe from abrasion against the central tunnel area of an automobile while driving.

Figure 2:
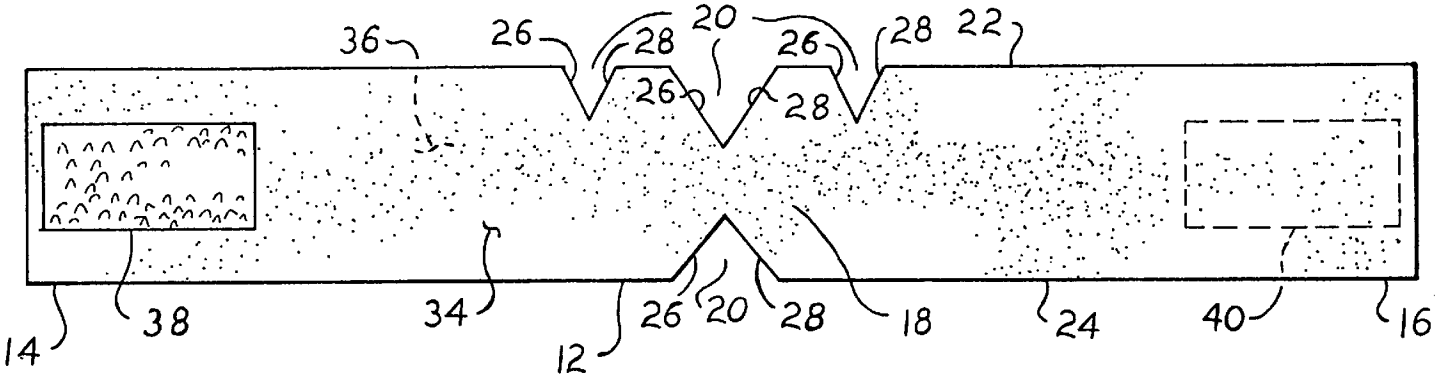
FIG. 2 is the outer surface of a flat blank or pattern for the construction of the present heel protector.
Figure 3:
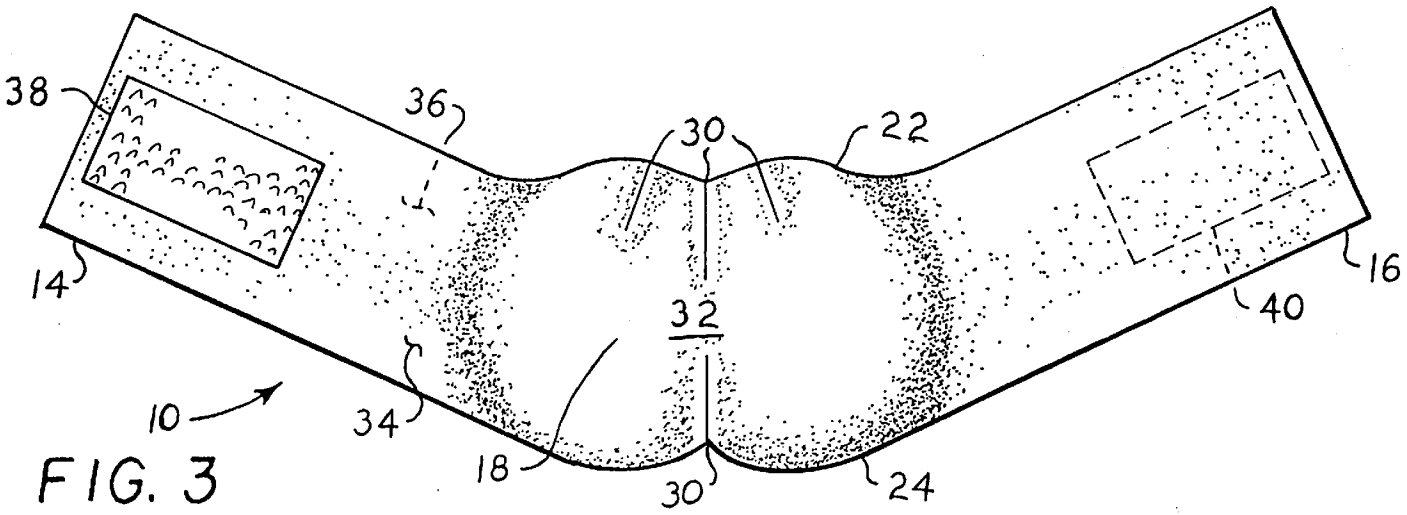
FIG. 3 is the outer surface of a completed heel protector formed from the blank or pattern of FIG. 2, showing the heel pocket area formed.

FIG. 2 provides a plan view of a material blank or pattern 12 which may be used in forming the shoe heel protector device 10. The material sheet 12 is a single, unbroken elongate strip of leather, vinyl, or other suitable material, having a first end 14 and an opposite second end 16. In the embodiment of FIGS. 1 through 3, the material sheet 12 has a generally rectangular configuration, with a constant width from end to end. However, other configurations may be used, depending upon the type, style, and size of shoe or boot to be protected, as will be seen further below.

The central area 18 of the shoe heel protector device 10, and material sheet 12 used to form the device 10, includes one or more darts 20 (V-shaped cuts) along the upper periphery 22 and opposite lower periphery 24 thereof. Preferably, a single dart 20 is formed centrally along the lower edge or periphery 24, with a series of three darts 20 formed along the upper edge or periphery 22. It will be noted that the centermost upper dart 20 is somewhat larger than the darts 20 to either side thereof, to provide for the gathering of a slightly greater amount of material at the area of greatest curvature of the shoe to which the present protector 10 is applied. However, different sizes and numbers of darts may be provided, depending upon the size of the material sheet used to form the heel protector, the size and type of shoe, the degree of coverage desired, etc.

Each of the darts 20 is defined by a first edge 26 and an opposite second edge 28, with the edges 26/28 of each dart 20 being drawn together and secured together to form a seam 30, as shown in the completed heel protector 10 of FIG. 3. Preferably, the dart edges 26/28 are sewn together using conventional stitching; other suitable alternative edge securing means may be used as desired.

It will be seen that the drawing together of the edges 26/28 of each of the darts 20 will gather the material along the peripheries 22/24 of the sheet 12, thus forming a heel pocket 32 in the central area 18 between the two peripheries 22/24. The sheet 12 of FIG. 2 and the completed heel protector 10 of FIGS. 1 and 3 are shown with their outer or first surfaces 34 facing upwardly, with their inner or second surfaces 36 being oppositely disposed. Thus, the heel pocket 32 of the heel protector 10 of FIG. 3 is shown in convex form in that figure, with the lower rear heel portion of a shoe fitting within the concave pocket adjacent the inner or second surface of 36 the device 10.

The opposite first and second ends 14 and 16 of the shoe heel protector device 10 each include some form of mating fastening or attachment means thereon, such as the first hook and loop fastener material 38 (e. g., Velcro, tm) stitched or otherwise secured to the first or outer surface 34 of the first end 14, and the mating second hook and loop fastener material 40 secured to the opposite second or inner surface 36 of the second end 16. When the device 10 is applied to the shoe heel, the two ends are overlapped with the attachments being secured together to hold the device 10 in place.

The shoe heel protector 10 is applied to a shoe S as shown in FIG. 1 The heel pocket 32 is placed around the lower rear edge of the shoe heel H, with the lower portion of the pocket 32 adjacent the lower periphery 24 fitting beneath the bottom surface B of the heel H and the upper portion of the pocket 32 adjacent the upper periphery 22 fitting around the rearward surface R and at least the lower portion of the counter C extending upwardly therefrom. The two opposite ends 14 and 16 are then folded forwardly and upwardly around the upper portion of the foot and shoe, with the second end 16 overlapping the first end 14 so the two mating attachment portions 38/40 face and engage one another to secure the device 10 removably about the shoe S.

The above described configuration serves to secure the present shoe heel protector device 10 immovably about the shoe S and foot, as the central portion 18 of the device 10 cannot rise relative to the shoe heel H due to the portion of the pocket 32 adjacent the lower periphery 24 which extends beneath the bottom surface B of the heel H, and cannot shift forward due to the portion of the pocket 32 adjacent the upper periphery 22 which extends upwardly adjacent the rear surface R of the heel H and the counter C. Downward and rearward movement of the heel protector device 10 is precluded by means of the forwardly and upwardly extending ends 14 and 16, which are secured to one another over the top of the foot or shoe S in front of the ankle.

Figure 4:
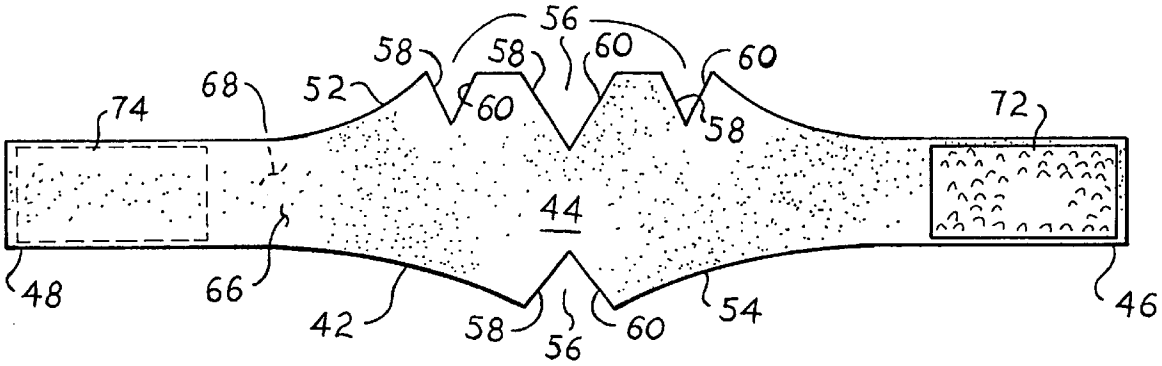
FIG. 4 is the inner surface of a flat blank for the construction of a heel protector for high heeled shoes.
Figure 5:
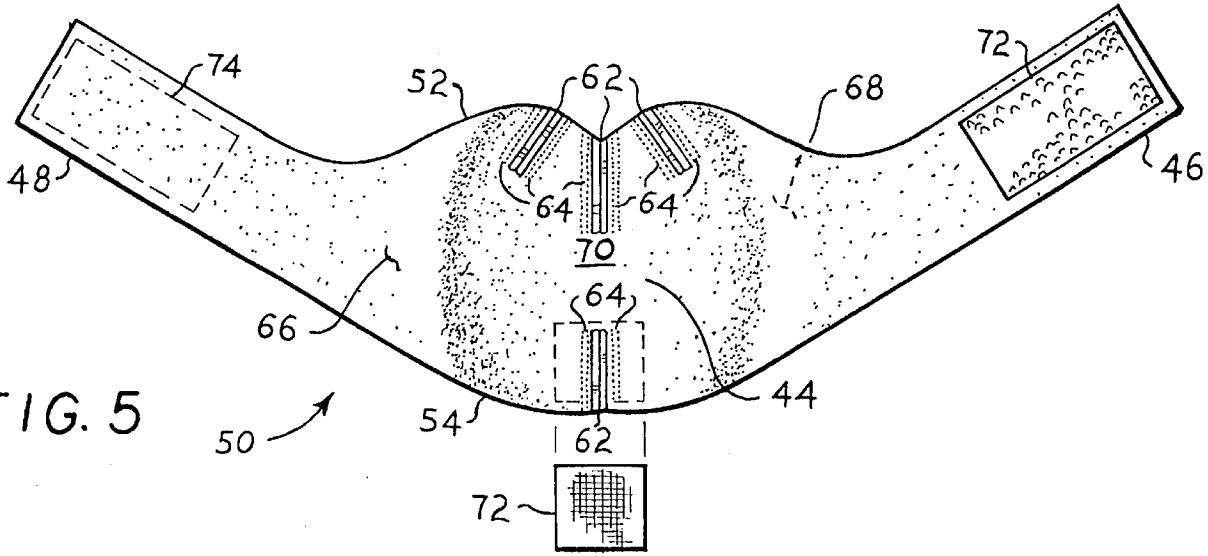
FIG. 5 is a completed high heel shoe protector, showing the optional addition of a reinforcing patch to the inner surface thereof.
Figure 6:
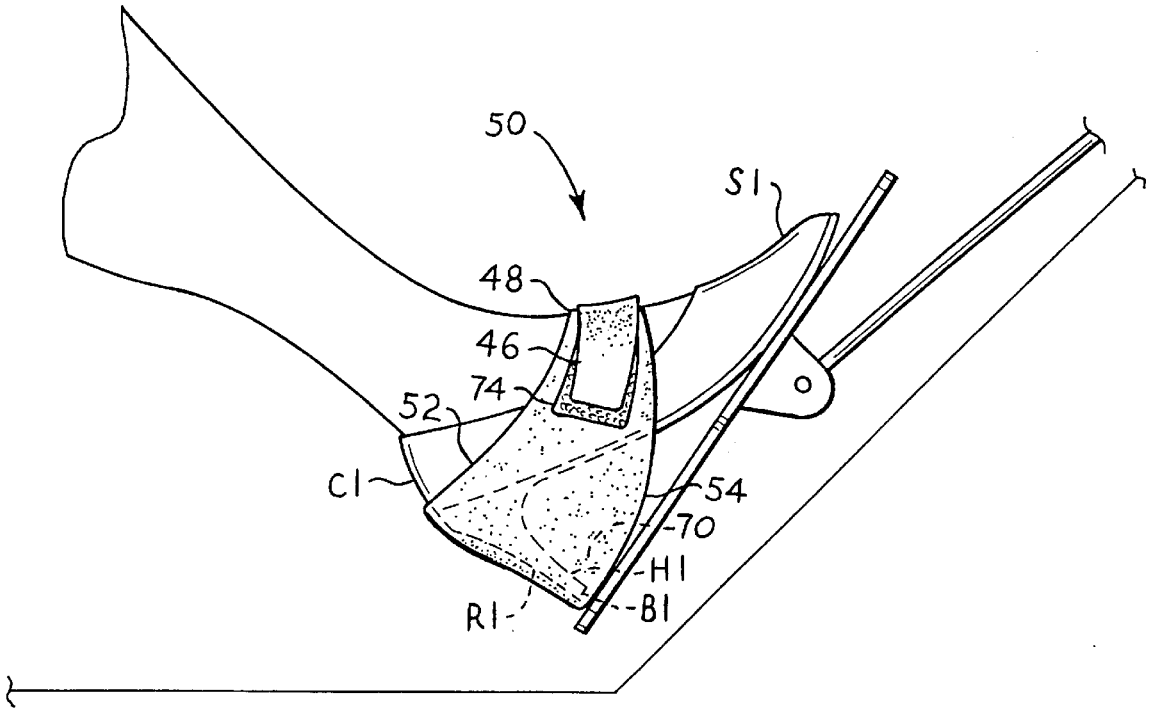
FIG. 6 is a side elevation view of the second embodiment heel. protector of FIGS. 4 and 5 in use on a high heeled shoe.

FIGS. 4 through 6 disclose a second embodiment of the present shoe heel protector, formed from a tapered sheet of material 42 as shown in FIG. 4. The material is preferably of leather or vinyl, as in the case of the heel protector 10 of FIG. 1, but the central area 44 is wider than each of the ends 46 and 48, with the device having a smoothly curved taper from the central area 44 to the first and second ends 46 and 48. This shape or configuration is well suited for use with a high heeled shoe, as shown in FIG. 6.

As in the shoe heel protector 10 of FIGS. 1 through 3, the high heel shoe protector 50 of FIGS. 4 through 6 includes an upper and opposite lower periphery, respectively 52 and 54, each having at least one dart 56 formed therein. (Preferably, three such darts 56 are formed along the upper periphery 52 of the central area 44, with a single dart 56 formed along the lower periphery 54.) These darts 56 each have a first edge 58 and an opposite second edge 60, which are secured together along seams 62 as shown in FIG. 5, by double stitching 64 or other suitable means. (It should be noted that the shoe heel protector 50 of FIGS. 4 and 5 is inverted relative to the heel protector 10 of FIGS. 1 through 3, with the second or inner surface 66 facing upwardly and the opposite first or outer surface facing downwardly. Accordingly, the seam 62 edges and the double stitching 64 therethrough are clearly shown in FIG. 5, with the heel pocket 70 forming a concave shape when viewed as in the plan view of FIG. 5.)

The heel protector 50 of FIGS. 4 through 6 is adapted for the protection of the heel and counter of a high heeled shoe S1, as shown in FIG. 6. The heel protector 50 is applied to the shoe S1 in a manner similar to that described above for the heel protector 10 and shoe S, with the bottom surface B1 of the heel H1 resting in the lower portion of the heel pocket 70 near the lower periphery 54. The upper portion of the pocket 70 near the upper periphery 52 extends upwardly along the rear surface R1 of the heel Hi, to cover the counter C1 at least partially. The two ends 46/48 are wrapped around in front of the ankle and secured together over the top of the foot using mating first and second components 72 and 74 of hook and loop fastening material (Velcro, tm) or other suitable means. With the heel pocket 70 precluding upward or forward movement of the heel protector 50, and the secured ends 46 and 48 precluding downward or rearward movement, the heel protector 50 is immovably secured about the back of the shoe S1 until removal is desired.

It will be seen that a great deal of pressure may be imposed by the relatively small area of the heel bottom B1 of a high heeled shoe S1. Accordingly, a heel reinforcement patch 72 may be stitched or otherwise secured within the heel pocket 70, over the dart seam 62 adjacent the lower periphery 54 and across the inner surface 66 of the protector 50. This area is positioned immediately below the heel bottom B1 when the heel protector 50 is being worn, to reinforce this high pressure area. It will be seen that a similar reinforcement patch (not shown) may also be installed in the protector 10 of FIGS. 1 through 3, if desired.

In summary, the present shoe heel protector in its various embodiments will be seen to provide a most useful and practical means of maintaining formal footwear in good condition while driving a motor vehicle. The present heel protector is constructed of a durable material which is capable of absorbing considerable wear and tear, while protecting the surface of the heel and counter of the shoe, where most wear and damage occurs against the conventional central floor tunnel in most motor vehicles. The present protector is easily applied and removed, by means of the preferred hook and loop fastening material, and may be kept in the car for use as required. The heel pocket construction, having no holes or passages therethrough, provides complete coverage of the most critical areas of the shoe, yet is easily constructed by means of securing the edges of the darts together along the upper and lower peripheries to gather those edges together. Accordingly, the present shoe heel protector will prove to be a desirable accessory for many persons who have occasion to wear formal footwear while driving a motor vehicle.

(It is to be understood that the present invention is not limited to the sole embodiments described above, but encompasses any and all embodiments within the scope of the following claims.

I claim:

1. A shoe heel protector for the protection of the heel and counter of a shoe, with the shoe heel having a bottom surface and a rearward surface with the counter extending upwardly therefrom, comprising:

an elongate device constructed of a single unbroken rectangular strip of flat, planar material having a first end and an opposite second end and a first surface and an opposite second surface;

said device including a central area with an upper periphery and an opposite lower periphery, said upper periphery of said central area includes three darts formed therein and said lower periphery of said central area includes a single dart formed therein;

each said dart including a first edge and an opposite second edge, with said first edge and said second edge of each said dart being secured together to gather said upper periphery and said lower periphery and to form a heel pocket therebetween for removably fitting about the counter, rearward surface, and at least a portion of the bottom surface of the shoe heel, said first end and said second end including mating first and second attachment means disposed respectively upon said first surface of said first end and said second surface of said second end, said mating first and second attachment means comprising a first portion and a second portion of hook and loop fastening material, with said heel pocket precluding upward and forward movement and said first end and said second end precluding downward and rearward movement of said device relative to the shoe when said first end and said second end are secured together over the shoe, and;

a heel reinforcement patch affixed within said heel pocket and over said at least one dart of the lower periphery, with said heel reinforcement patch being disposed beneath at least a portion of the bottom surface of the shoe heel when said device is applied to the shoe.

2. The shoe heel protector according to claim 1, wherein:

said first edge and said second edge of each said dart are stitched together.

3. The shoe heel protector according to claim 1, wherein:

said device is formed of leather.

4. The shoe heel protector according to claim 1, wherein:

said device is formed of vinyl.

5. A shoe heel protector for the protection of the heel and counter of a shoe, with the shoe heel having a bottom surface and a rearward surface with the counter extending upwardly therefrom, comprising:

an elongate device constructed of a single unbroken strip of flat, planar material having a first end and an opposite second end and a first surface and an opposite second surface;

said device including a central area with an upper periphery and an opposite lower periphery, with said upper periphery of said central area includes three darts formed therein and said lower periphery of said central area includes a single dart formed therein;

said central area being wider than each said end and said device having a smoothly curved taper from said central area to each said end;

each said dart including a first edge and an opposite second edge, with said first edge and said second edge of each said dart being secured together to gather said upper periphery and said lower periphery and to form a heel pocket therebetween for removably fitting about the counter, rearward surface, and at least a portion of the bottom surface of the shoe heel, said first end and said second end including mating first and second attachment means disposed respectively upon said first surface of said first end and said second surface of said second end, said mating first and second attachment means comprising a first portion and a second portion of hook and loop fastening material, with said heel pocket precluding upward and forward movement and said first end and said second end precluding downward and rearward movement of said device relative to the shoe when said first end and said second end are secured together over the shoe, and;

a heel reinforcement patch affixed within said heel pocket and over said at least one dart of the lower periphery, with said heel reinforcement patch being diposed beneath at least a portion of the bottom surface of the shoe heel when said device is applied to the shoe.

6. The shoe heel protector according to claim 5, wherein:

said first edge and said second edge of each said dart are stitched together.

7. The shoe heel protector according to claim 5, wherein:

said device is formed of leather.

8. The shoe heel protector according to claim 5, wherein:

said device is formed of vinyl.

9. A method of making a shoe heel protector for the protection of the heel and counter of a shoe, with the shoe heel having a bottom surface and a rearward surface with the counter extending upwardly therefrom, comprising the following steps:

(a) providing a single elongate, unbroken strip of flat, planar material having a first end and an opposite second end, a first surface and an opposite second surface, and a central area with an upper periphery and an opposite lower periphery;

(b) forming three darts in the upper periphery and a single dart in the lower periphery of the central area, with each dart having a first edge and an opposite second edge;

(c) securing the first edge and second edge of each dart together, thereby gathering the upper periphery and lower periphery and forming a heel pocket therebetween for removably fitting about the counter, rearward surface, and at least a portion of the bottom surface of the shoe heel, (d) securing mating first and second attachments respectively upon the first surface of the first end and the second surface of the second end, said mating first and second attachment means comprising a first portion and a second portion of hook and loop fastening material, with the heel pocket precluding upward and forward movement and the first end and second end precluding downward and rearward movement of the device relative to the shoe when the first end and second end are secured together over the shoe by the first and second attachments, and;

a heel reinforcement patch affixed within said heel pocket and over said at least one dart of the lower periphery, with said heel reinforcement patch being disposed beneath at least a portion of the bottom surface of the shoe heel when said device is applied to the shoe.

10. The method of making a shoe heel protector according to claim 9, including the step of:

stitching the first and second edge of each dart together and stitching the first and second attachments to each respective end.

11. The method of making a shoe heel protector according to claim 9, including the step of:

forming the device from materials selected from the group consisting of leather and vinyl.

* * * * *